US006382354B2

(12) United States Patent
Ahl et al.

(10) Patent No.: US 6,382,354 B2
(45) Date of Patent: May 7, 2002

(54) LADDER SUPPORTED CONTAINER

(75) Inventors: Frank E. Ahl; Brian E Ahl, both of Elliston; Leonard B. Eckel, Clancy, all of MT (US)

(73) Assignee: Ahl, Inc., Elliston, MT (US)

( * ) Notice: Subject to any disclaimer, the term of this patent is extended or adjusted under 35 U.S.C. 154(b) by 0 days.

(21) Appl. No.: 09/771,134

(22) Filed: Jan. 26, 2001

Related U.S. Application Data

(60) Provisional application No. 60/192,781, filed on Mar. 28, 2000.

(51) Int. Cl.[7] ..... E06C 7/14

(52) U.S. Cl. ..... 182/129; 248/210

(58) Field of Search ..... 248/210, 211, 248/217.1, 238; 182/129; D25/68; 224/560, 555

(56) References Cited

U.S. PATENT DOCUMENTS

| | | | | | |
|---|---|---|---|---|---|
| 768,364 | A | * | 8/1904 | Hines | 211/66 |
| 787,911 | A | | 4/1905 | Gehardt | 248/210 |
| 2,541,390 | A | | 2/1951 | Weigand | 248/210 |
| 2,601,413 | A | | 6/1952 | Miles | 248/211 |
| 3,013,759 | A | | 12/1961 | Close | 248/218.4 |
| 3,272,467 | A | | 9/1966 | Kassube | 248/211 |
| 3,474,996 | A | * | 10/1969 | Stamm | 248/210 |
| 3,593,951 | A | | 7/1971 | Warner | 248/210 |
| 3,661,351 | A | | 5/1972 | Olsen | 248/210 |
| 3,837,034 | A | * | 9/1974 | Leffert et al. | 15/257.06 |
| D272,415 | S | | 1/1984 | Case | D8/373 |
| 4,527,763 | A | | 7/1985 | Woytowich | 248/238 |
| 4,984,763 | A | * | 1/1991 | O'Donnell | 248/211 |
| 5,305,977 | A | * | 4/1994 | Roth | 248/210 |
| 5,379,536 | A | * | 1/1995 | Lorenzana | 108/31 |
| 5,493,751 | A | | 2/1996 | Misiukowiec | 15/257.06 |
| 5,865,409 | A | * | 2/1999 | Nimer | 248/110 |

FOREIGN PATENT DOCUMENTS

| | | | | |
|---|---|---|---|---|
| FR | 1029741 | * | 3/1953 | 248/210 |
| FR | 3633201 | * | 6/1988 | 248/210 |

* cited by examiner

*Primary Examiner*—Anita King
*Assistant Examiner*—Jon Szumny
(74) *Attorney, Agent, or Firm*—Saliwanchik, Lloyd & Saliwanchik

(57) ABSTRACT

A ladder supported container including a bottom panel and an upstanding peripheral wall defining the interior of the container. A lip is disposed on the upstanding peripheral wall proximate to the top portion of the upstanding peripheral wall. The lip extends laterally outwardly from the upstanding peripheral wall and includes an outward facing rail contact surface. The lip typically further includes two pivot supports disposed at a position intermediate the rail contact surface of the lip and the first wall section of the container. The container further includes a U-shaped bracket disposed within the pivot supports. The bracket includes a rail engaging section disposed outwardly from the rail contact surface of the lip at a spaced apart lateral distance from the rail contact surface of the lip. The spaced apart distance defines a ladder rail receiving gap. The bracket is freely rotatable within the pivot supports from at least a first position where the bracket is supported by the lip to a second position where the bracket has rotated upwardly from the lip and the lateral distance between the bracket rail engaging section and the rail contact surface has shortened. In the second position, the bracket is able to pinch a ladder rail between the bracket rail engaging section and the rail contact surface of the lip.

18 Claims, 5 Drawing Sheets

LADDER SUPPORTED CONTAINER

RELATED APPLICATIONS

The present application claims the benefit under Title 35, United States Code, Section 119E of the U.S. Provisional Patent Application Ser. No. 60/192,781, filed Mar. 28, 2000 entitled "Ladder Tray With Hinged Bracket".

BACKGROUND

Ladder supported containers suitable for holding hardware or paint have existed in various configurations. These containers typically utilize support members that permit temporary attachment of the container to a step ladder or an extension ladder. A common problem associated with ladder supported containers is that such containers are often specifically designed to attach to a single type of ladder. Furthermore, these ladder supported containers often only permit attachment to a specific configuration of step ladder or a specific configuration of extension ladder. As many variations of ladders exist in the marketplace there can be difficulty in finding a proper container that the ladder will accommodate.

Another problem associated with typical ladder supported containers has been the attachment means utilized to secure the containers to a ladder. These containers typically require attachment either to two steps of a step ladder; to a step of a step ladder and the ladder rail; or to two spaced apart rungs of an extension ladder. Other container designs attach to the ladder rail only but require some disassembly and reassembly to do so or require the use of fasteners. Due to the variations in ladder construction, the supporting members of the containers often have to be adjusted when possible to securely attach the container to a ladder. Where adjustment isn't possible often the container cannot be utilized with particular ladders.

Existing ladder supported containers are often problematic to mount on a ladder because of the necessity to attach at more than one point on the ladder. Additionally, most ladder supported containers require the user to hold the container with one hand, while attaching the container to the ladder with a second hand. This is particularly difficult when the attachment means includes fasteners. It is both difficult and dangerous to devote both hands to mounting a container to a ladder when the user is standing on the ladder. If the ladder supported container mounts in a manner where the container is not centered on the ladder but is cantilevered off the ladder and attaches to the ladder rail, the attachment process becomes even more difficult and dangerous. In an arrangement of this type the user must lean away from the ladder while holding the container while also fastening the container to the ladder.

Existing container designs that utilize a single step for attachment typically utilize a support on the container which can be attached to a single rung or step and from which the container hangs. A problem associated with this design is the lack of stability of a container that can easily be accidentally moved in relation to the ladder. Furthermore, the support devices used to hang the container are located above the container interior and often block access to the container interior. Container supports of this type often do not have a secure attachment to the container, as well, and allow the container to swing in relation to the support if the support is used to carry the container up or down the ladder.

An additional problem with existing ladder supporting containers is the instability of the container when the containers are not in attachment to a ladder. Filling a container with paint or other items is difficult as the user must somehow support the container to do so. Use of a container of this type when off the ladder is extremely restricted and often not even possible.

Still another problem with existing ladder supported containers is the absence of a suitable handle. Many containers do not have a handle and require the user to grab on to the container wherever possible. This is problematic to the user who is required to both hold the container while moving up and down the ladder, and to hold the container while securing the container to the ladder. Not finding an adequate area to hold on to the container can be both difficult and dangerous to the user while moving the container or securing it to the ladder.

Container designs that do utilize a handle have problems associated with the use of the handle. Many handles also additionally serve as the support from which the container hangs. In this design the handle is typically located above the container, often obstructing the user from the container itself. Additionally, the user of a container of this type has to mount the handle onto a step or rung and then somehow remove his or her hand from the handle once the handle is attached to the ladder.

Other container designs that also include a handle make the handle only useful when moving up or down the ladder. The handle in these container designs is often unusable during the mounting of the container on the ladder. This requires the user to hold onto a different portion of the container during securement of the container to the ladder, a process which is both difficult and dangerous when standing atop a ladder.

Because of the aforementioned reasons there is a need for a ladder supported container that securely and easily mounts and dismounts to different types of ladders and, will securely mount to a step ladder, to an extension ladder when fully extended, or to an extension ladder in a position when the ladder sections are overlapping. There is also a need for a ladder supported container that includes a container portion that extends laterally outwardly from the ladder so as not to interfere with the normal operation of the ladder. There is a further need for a ladder supported container that allows the user to mount the container with one hand only and includes no fasteners and additionally includes no support member that will obstruct the user from accessing the container portion of the container. There is still further need for a ladder supported container that is self supporting when the container is not attached to a ladder; and, provides a secure handle for easily holding the container while moving the container, or while securing the container to a ladder which does not interfere with utilizing the container once mounted to a ladder.

SUMMARY

The ladder supported container of the present invention includes a bottom panel and an upstanding peripheral wall. The upstanding peripheral wall typically includes four wall sections which extend upwardly from the bottom panel. The bottom panel and the upstanding peripheral wall define the interior of the container.

A lip is disposed on the upstanding peripheral wall proximate to the top portion of the upstanding peripheral wall. The lip extends laterally outwardly from the upstanding peripheral wall. A first lip section extends from the first wall section. The first lip section includes an outward facing rail contact surface. The lip extends laterally outwardly but typically not upwardly from the peripheral wall of the container. The lip further includes two pivot supports disposed at a position intermediate the rail contact surface of the lip and the first wall section of the container.

The container further includes a bracket disposed within the pivot supports. The bracket includes a first section disposed within the pivot supports which is freely rotatable within the pivot supports; a second section extending from the first section at substantially a right angle from the first section; a third section extending rearwardly from the second section in a direction substantially at a right angle to the second section and substantially parallel to the length of the lip. The third section is disposed outwardly from the rail contact surface of the lip at a spaced apart lateral distance from the rail contact surface of the lip. The spaced apart distance defines a ladder rail receiving gap. The bracket further includes a fourth section disposed at the distal end of the bracket and extending from the third section at substantially a right angle to the third section. The bracket first, second, and third sections define a "U" shape.

The bracket is freely rotatable within the pivot supports from at least a first position where the bracket second section is supported by the first lip section; to a second position where the second section has rotated upwardly in a clockwise direction from the lip section and the lateral distance between the third section and the rail contact surface has shortened. In the second position, the bracket is able to pinch a ladder rail between the bracket third section and the rail contact surface of the lip.

A bail serves as a handle for the container. The bail rotates relative to the container so as to be moved to a position where the bail does not restrict the access to the interior of the container.

The container easily mounts and dismounts to different types of ladders and, will securely mount to a step ladder, to an extension ladder when fully extended, or to an extension ladder in a position when the ladder sections are overlapping. The ladder supported container extends laterally outwardly from the ladder so as not to interfere with the normal operation of the ladder. The ladder supported container allows the user to mount the container with one hand only and includes no fasteners and additionally includes no support member that will obstruct the user from accessing the container portion of the container. The ladder supported container is self supporting when the container is not attached to a ladder; and, provides a secure handle for easily holding the container while moving the container, or while securing the container to a ladder which does not interfere with utilizing the container once mounted to a ladder.

DRAWINGS

DESCRIPTION

Figure 1:
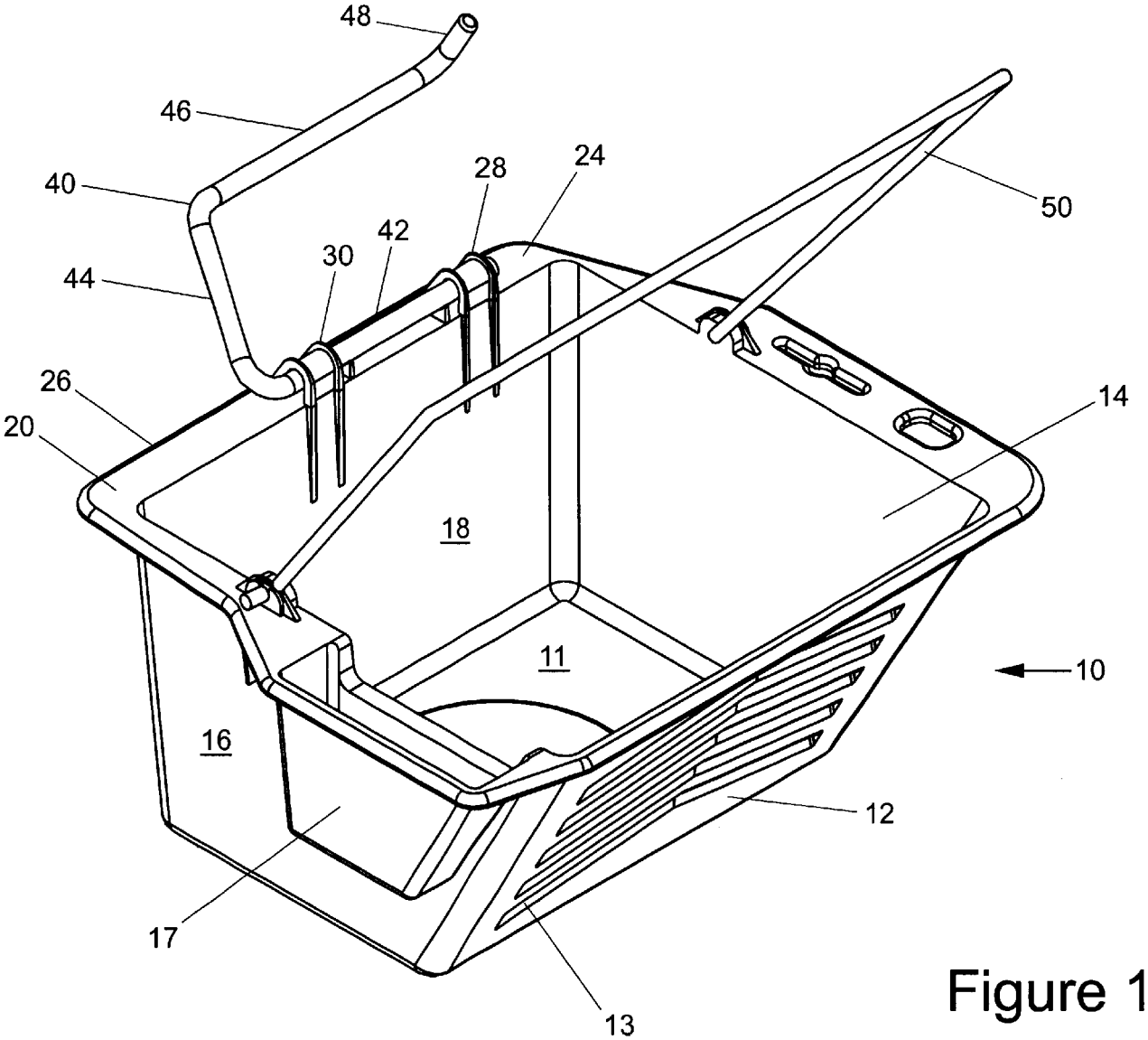
FIG. 1 is a perspective view showing the container.

FIG. 1 is a perspective view showing the container 10 which includes a bottom panel 11 and an upstanding peripheral wall. The upstanding peripheral wall including four wall sections 12, 14, 16, and 18 which extend upwardly from the bottom panel. Each wall section includes a bottom portion attached to the bottom panel and a top portion. The bottom panel and the upstanding peripheral wall define the interior of the container.

The wall section 12 includes chevron shaped projections 13 which are useful for engagement by the brush of a paint roller. The wall section 16 includes a brush receptacle 17.

A lip 20 is disposed on the upstanding peripheral wall proximate to the top portion of the upstanding peripheral wall. The lip 20 extends laterally outwardly from the upstanding peripheral wall. A first lip section 24 extends from the first wall section 18. The first lip section 24 includes an outward facing rail contact surface 26. The first lip section 24 has a width defining the distance the lip extends laterally outwardly from the wall section 18 to the rail contact surface 26 and a length which typically extends the width of the wall section 18. The lip extends laterally outwardly but not upwardly from the peripheral wall of the container.

The lip further includes two pivot supports 28 and 30. The pivot supports are disposed at a position intermediate the rail contact surface of the lip and the wall section 18 of the container. The pivot supports 28 and 30 are disposed at a spaced apart distance from the rail contact surface of the lip and the wall section 18. The pivot supports comprise loops.

The container 10 further includes a bracket disposed within the pivot supports 28 and 30. The bracket 40 includes a first section 42 disposed within the pivot supports and freely rotatable within the pivot supports; a second section 44 extending from the first section at substantially a right angle from the first section 42; a third section 46 extending rearwardly from the second section 44 in a direction substantially at a right angle to the second section 44 and substantially parallel to the length of the lip 24. The third section 46 is disposed outwardly from the rail contact surface of the lip 26 at a spaced apart lateral distance from the rail contact surface of the lip 26. The spaced apart distance defines a ladder rail receiving gap. The bracket further includes a fourth section 48 disposed at the distal end of the bracket and extending from the third section 46 at substantially a right angle to the third section 46. The bracket first, second, and third sections define a "U" shape.

The bracket 40 is freely rotatable within the pivot supports 28 and 30 from at least a first position where the bracket second section 44 is supported by the first lip section 24; to a second position where the second section 44 has rotated upwardly clockwise from the lip section 24 and the lateral distance between the third section 46 and the rail contact surface 26 has shortened. In FIG. 1, the bracket is shown rotated slightly upwardly away from the first position so that the second section 44 is not supported by the lip section 24.

Also shown in FIG. 1 is a bail 50 that serves as a handle for the container. The bail rotates relative to the container so as to be moved to a position where the bail does not restrict the access to the interior of the container. The bail is removed from the container in FIGS. 2 through 5.

Figure 2:
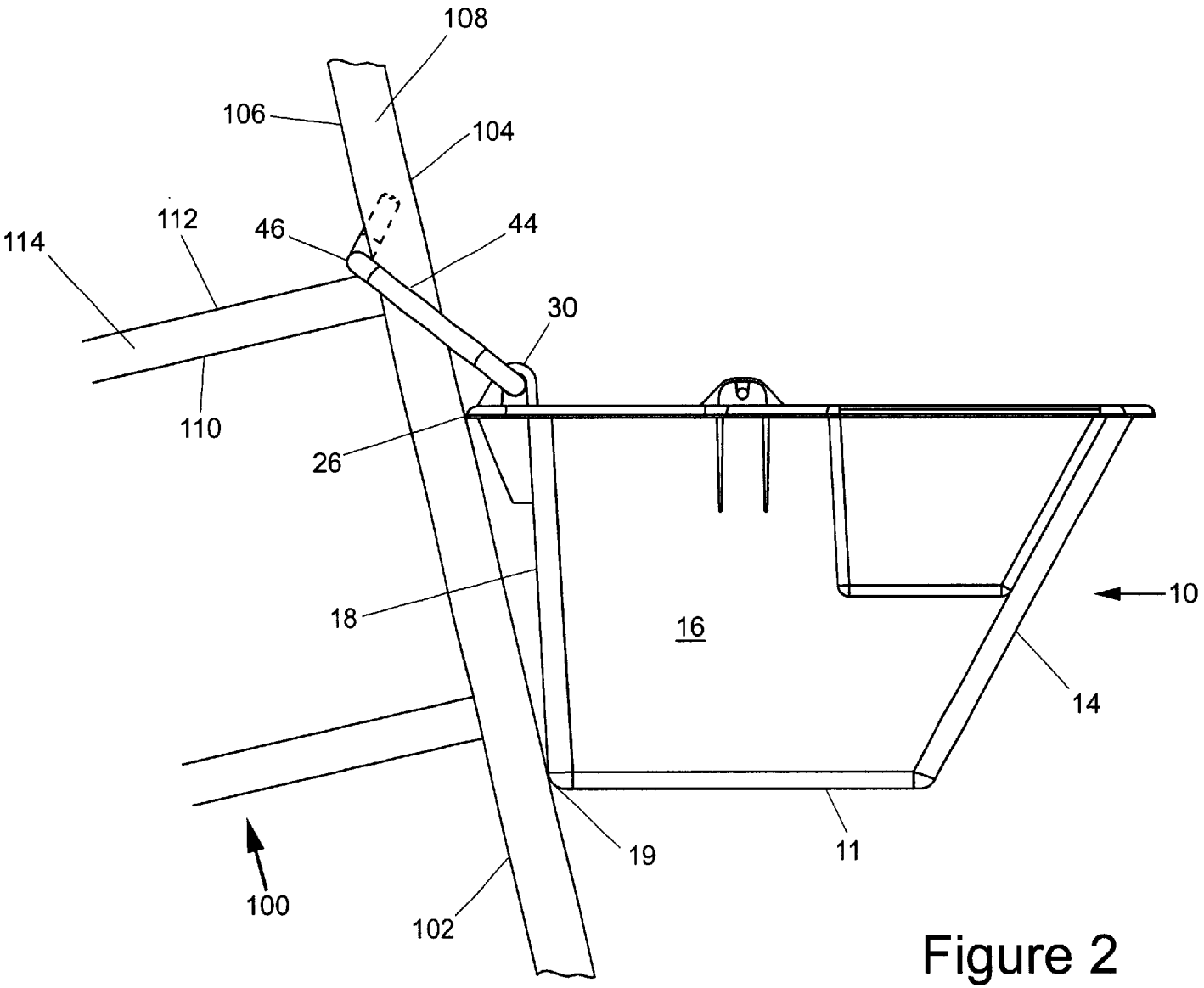
FIG. 2 shows the container disposed on a ladder in a front view.

FIG. 2 shows the container 10 disposed on a ladder 100 from a front view. The ladder includes a rail 102 which includes an outer surface 104, an inner surface 106, and a front surface 108. Not shown in this figure is the back surface 109. The ladder includes a plurality of steps 110. Each step includes a top surface 112 and a front surface 114.

As shown, once the container 10 is disposed on the ladder 100, the ladder rail 102 is disposed within the rail receiving gap which separates the bracket third section 46 from the rail contact surface 26. The bracket is shown after having rotated clockwise to a second position wherein the ladder rail 102 is pinched between the rail contact surface of the lip 26 and the bracket third section 46. The bracket third section 46 rests atop the top surface 112 of the step 110. The bracket second section 44 is disposed in front of the front surface 108 rail.

Also shown in this view is the position of the bracket fourth section 48, shown in dotted lines as it is hidden by the ladder rail. As will be shown in FIG. 3, as the bracket rotates within the pivot supports, the fourth section moves into engagement with the back surface 109 (not shown in this view) of the ladder rail.

Also shown in FIG. 1, the container, when disposed on the ladder, results in the bottom 19 of the wall section 18 also contacting the ladder rail. This causes the wall section 18 to be disposed relative to the rail such that the wall section 18 angles outwardly away from the rail from the rail contact point at the bottom of the wall as the wall extends upwardly toward the lip. As the entire container has rotated clockwise so that the bottom 19 of the wall section 18 contacts the ladder rail outer surface 104, the frictional engagement of the bottom 19 of the wall section 18 against the rail outer surface 104 is substantial. This frictional engagement assists the securement of the container to the ladder. Accordingly, the bottom 19 of the wall section 18 is considered to include a rail contact surface.

The orientation of the container, as is shown in FIG. 2, further causes the bottom panel 11 to tilt slightly downwardly away from the ladder rail. Paint will accumulate proximate to the joint between the bottom panel 11 and the wall section 14. An accumulation of paint in this area is desirable as it is in the container immediately next to the angled wall section 14 which includes the roller engagement projections 13.

Figure 3:
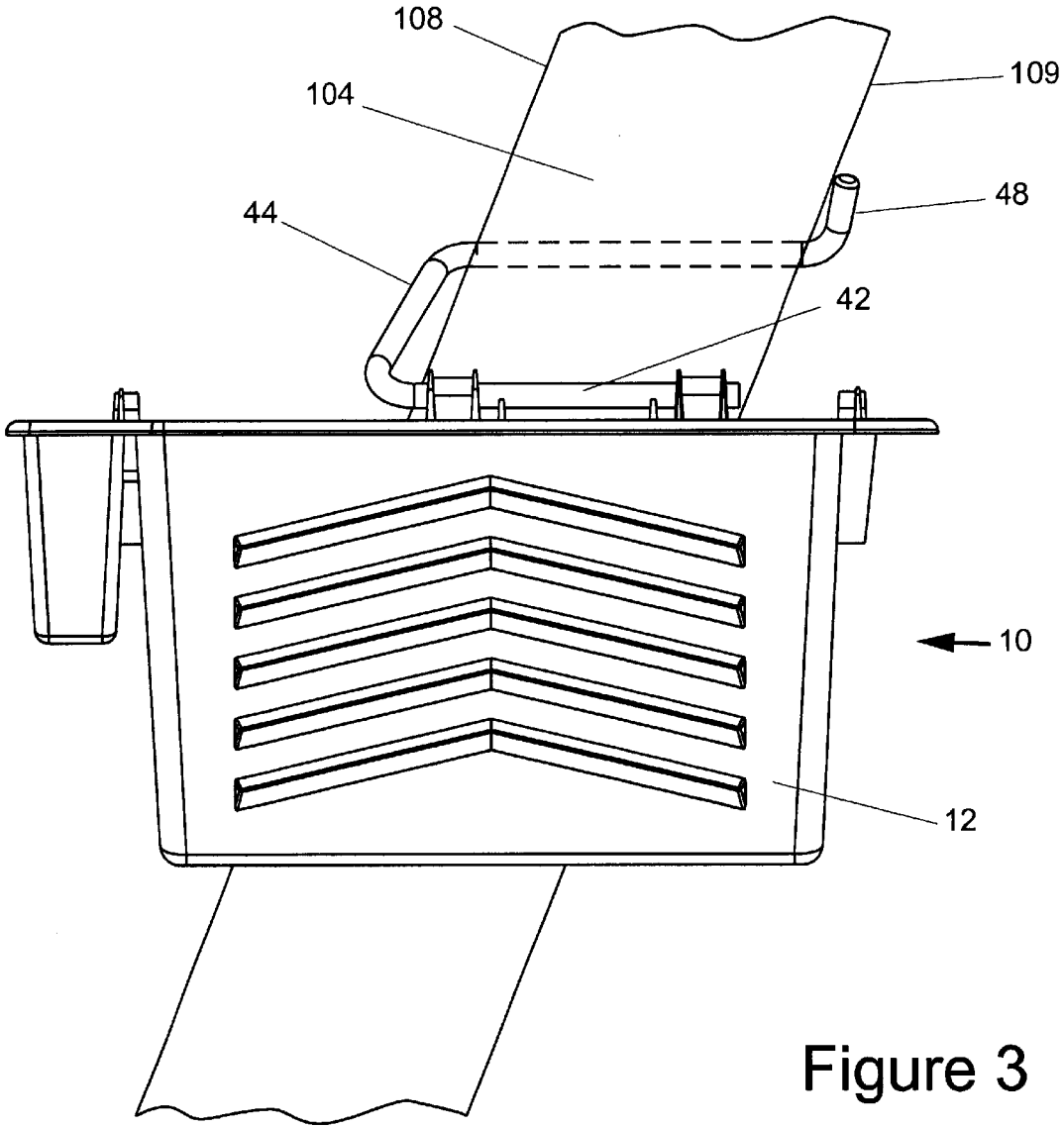
FIG. 3 shows the container disposed on the ladder in a side view.

FIG. 3 shows the container 10 disposed on the ladder from a side view. As is shown in this view, the second section 44 of the bracket is not at an exact right angle with the first section 42. Also shown in this view, is the position of the bracket fourth section 48 in engagement with the back surface 109 of the ladder rail. When the bracket is in this position, the container is locked onto the ladder and cannot move unless the container is lifted, resulting in the downward movement (counter clockwise movement) of the bracket.

Figure 4:
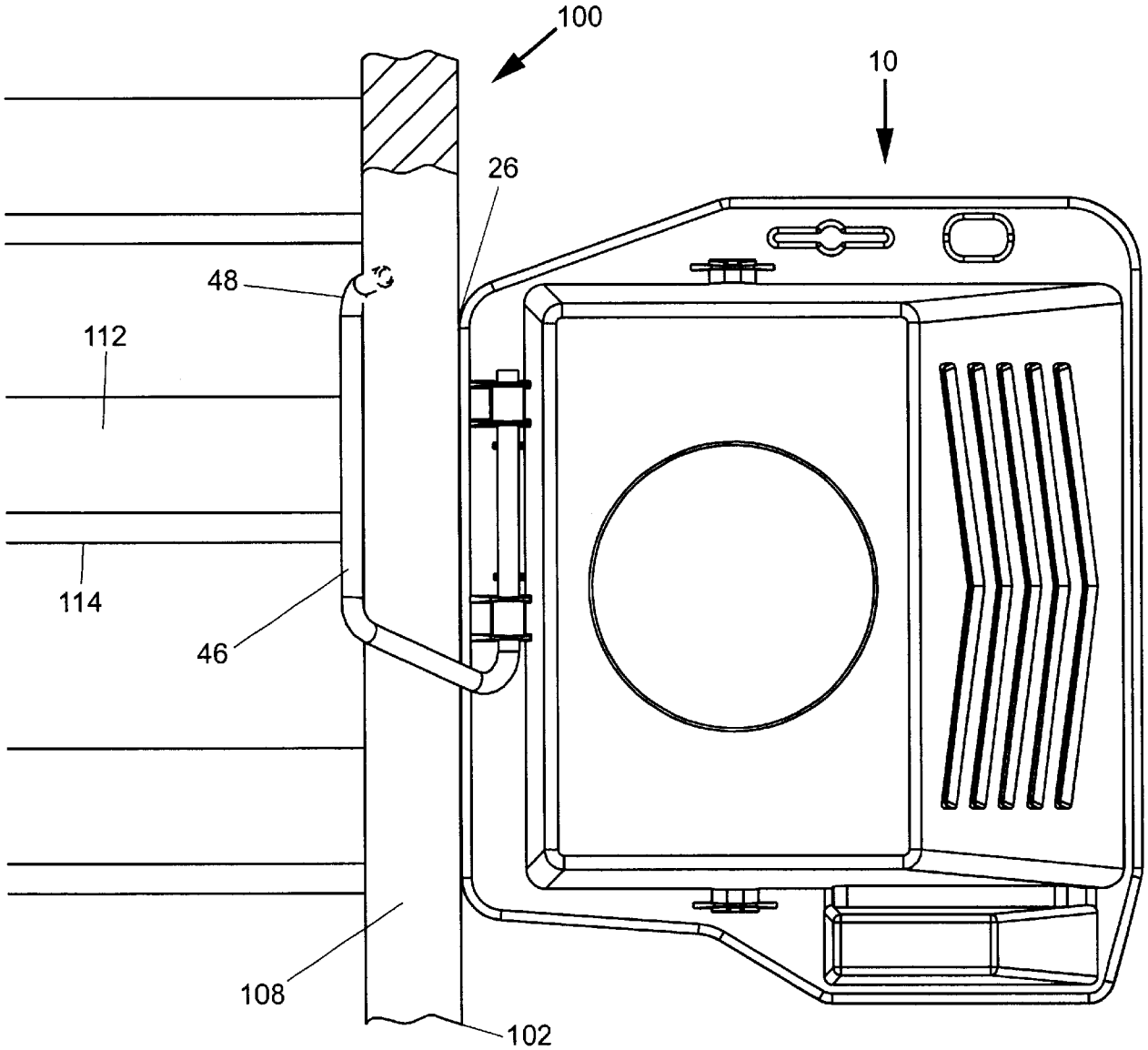
FIG. 4 is a top view showing the container disposed on the ladder.

FIG. 4 is a top view showing the container 10 disposed on the ladder 100. This view shows the ladder rail 102 pinched between the bracket third section 46 and the rail contact surface 26. Also shown is the typical configuration of the steps of commercially available ladders. The ladder top surface 112 and front surface 114 are shown.

Figure 5:
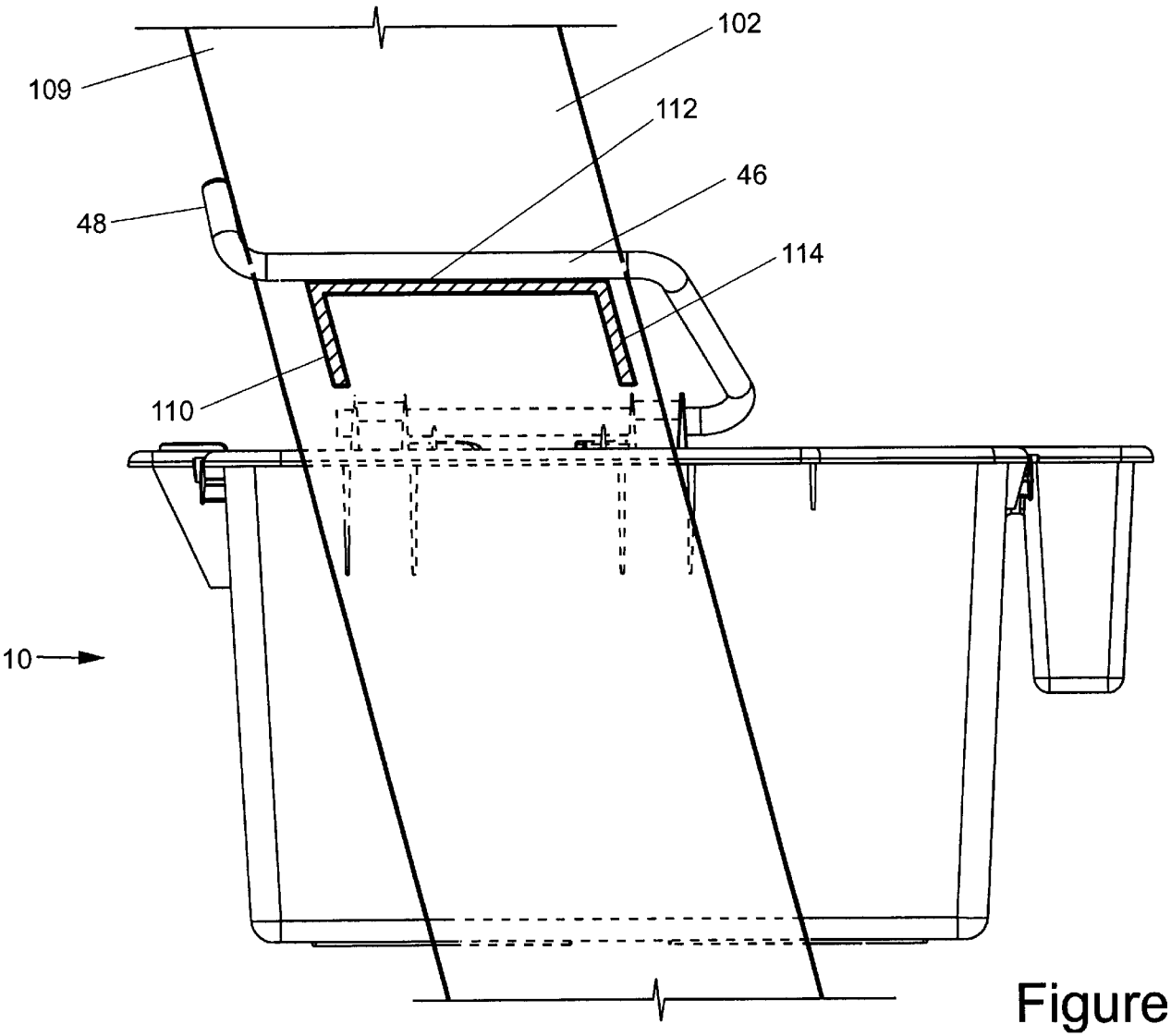
FIG. 5 shows the container disposed on the ladder in a side view.

FIG. 5 is a side view which shows the position of the bracket third section 46 relative to the ladder rail 102, and the bracket fourth section 48 relative to the rail back surface 109. Also shown is the ladder step 110 including the top surface 112 and the front surface 114.

In use, the container is attached to the ladder by moving the container rearward relative to the ladder. The ladder rail 102 is slid into the ladder rail receiving gap which separates the bracket third section 46 and the rail contact surface 26 of the lip. The bracket third section 46 is positioned above the step which is closest to the position on the ladder that the user desires the container to be located. When the ladder rail is entirely within the gap, the container is allowed to drop relative to the ladder. The continued downward movement of the container causes the clockwise rotation of the bracket relative to the container. The downward movement of the container causes the bracket third section 46 to rest onto the top surface 112 of the chosen step. The container moves downwardly a short distance until the ladder rail 102 is pinched between the bracket third section 46 and the rail contact surface 26 of the lip. At this position the container is allowed to tip (rotate counter clockwise) toward the ladder rail causing the rail contact surface at the bottom 19 of the wall section 18 to engage the ladder rail. The fourth section of the bracket 48 has also moved into engagement with the ladder rail back surface 109.

Removal of the container from the step simply involves the lifting of the container relative to the ladder. The bracket fourth section 48 will disengage from the ladder rail back surface 109 and the ladder rail receiving gap separating the bracket third section 46 from the rail contact surface 26 will increase as the bracket rotates counter clockwise. Accordingly, the ladder rail will no longer be pinched between the bracket third section 46 and the rail contact surface 26. The container can then be freely moved forward relative to the ladder and repositioned on the ladder.

Typically the container includes a substantially planar, substantially rectangular bottom and four substantially planar upstanding walls sections. Again, the four upstanding wall sections define the peripheral wall of the container. Typically the entire container is a single molded piece. Other container shapes are, of course, possible.

Although the container has only been shown attached to a single type of ladder, the container easily mounts and dismounts to different types of ladders, and will securely mount to a step ladder, to an extension ladder when fully extended, or to an extension ladder in a position when the ladder sections are overlapping. The bracket third section is the only portion of the container that contacts the ladder step and will contact or rest upon any configuration of step equally. The ladder supported container extends laterally outwardly from the ladder so as not to interfere with the normal operation of the ladder. The ladder supported container allows the user to mount the container with one hand only and includes no fasteners and additionally includes no support member that will obstruct the user from accessing the container portion of the container. The ladder supported container is self supporting when the container is not attached to a ladder; and, provides a secure handle for easily holding the container while moving the container, or while securing the container to a ladder which does not interfere with utilizing the container once mounted to a ladder.

Although the tray of the preferred version of the invention as shown in FIGS. 1 to 5 is shown designed specifically to accommodate a paint roller, the tray could be configured to accommodate other tools or hardware that could be used while on a ladder. It is also understood that various modifications and changes in form or detail could readily be made without departing from the spirit of the invention. It is therefore intended that the invention be not limited to the exact form and detail herein shown and describe, nor to anything less than the whole of the invention herein disclosed and as hereinafter claimed.

What is claimed is:

1. In combination a ladder and a container for temporary disposal on the ladder;

the ladder comprising:

at least two side rails and a plurality of steps disposed intermediate the side rails;

the container comprising:

a bottom panel and an upstanding peripheral wall; the upstanding peripheral wall including a bottom portion attached to the bottom panel and a top portion; the upstanding peripheral wall extending upwardly from the bottom panel; the bottom panel and the upstanding peripheral wall defining the interior of the container;

a lip disposed on the upstanding peripheral wall proximate to the top portion of the upstanding peripheral wall; the lip extending laterally outwardly from the upstanding peripheral wall; the lip including an outward facing rail contact surface; the lip having a width defining the distance the lip extends laterally outwardly from the upstanding peripheral wall to the rail contact surface and a length; the lip further including at least one pivot support; the pivot support disposed at a position intermediate the rail contact surface of the lip and the peripheral wall of the container at a spaced apart distance from the rail contact surface of the lip and the peripheral wall of the container;

a bracket disposed within the at least one pivot support on the lip;

the bracket including: a first section disposed within the pivot support and freely rotatable within the pivot support; a second section extending from the first section; and a third section extending rearwardly from the second section in a direction substantially parallel to the length of the lip; the third section disposed outwardly from the rail contact surface of the lip at a spaced apart lateral distance from the rail contact surface of the lip; the spaced apart distance defining a ladder rail receiving gap;

the bracket freely rotatable within the pivot support from at least a first position where the bracket second section is supported by the lip; to a second position where the second section has rotated upwardly from the lip and the lateral distance between the third section and the rail contact surface has shortened, wherein upon disposal of the container on the ladder the ladder rail is disposed within the rail receiving gap and the bracket is rotated to a second position wherein the ladder rail is pinched between the rail contact surface of the lip and the bracket third section, and the bracket third section rests atop a step.

2. The container of claim 1, wherein the container includes a substantially planar, substantially rectangular bottom and four substantially planar upstanding walls defining the peripheral wall of the container.

3. The container of claim 1, wherein the lip is integral with the container.

4. The container of claim 1, wherein the lip extends laterally outwardly but not upwardly from the peripheral wall of the container.

5. The container of claim 1, wherein the bracket is permanently disposed within the pivot support of the lip.

6. The container of claim 1, wherein each pivot support comprises a loop within which the bracket first section is disposed.

7. The container of claim 1, wherein the bracket first, second, and third sections define a "U" shape.

8. The container of claim 1, wherein the bracket further includes a fourth section disposed at the distal end of the bracket and extending from the third section at substantially a right angle to the third section.

9. The container of claim 1, wherein the lip is supported on a first wall section of the container, and wherein the container when disposed on the ladder results in the bottom of the first wall section also contacting ladder rail, and the first wall section being disposed relative to the rail such that the first wall section angles outwardly away from the rail from the rail contact point at the bottom of the first wall section, as the first wall section extends upwardly toward the lip; and wherein the container bottom slops downwardly as it extends away from the rail contact surface of the bottom of the first wall section.

10. The container of claim 1, wherein the ladder rail includes a front and a back, and wherein the bracket second section is disposed in front of the front of the rail.

11. A container for temporary disposal on a ladder;

the container comprising:

a bottom panel and an upstanding peripheral wall; the upstanding peripheral wall including a bottom portion attached to the bottom panel and a top portion; the upstanding peripheral wall extending upwardly from the bottom panel; the bottom panel and the upstanding peripheral wall defining the interior of the container;

a lip disposed on the upstanding peripheral wall proximate to the top portion of the upstanding peripheral wall; the lip extending laterally outwardly from the upstanding peripheral wall; the lip including an outward facing rail contact surface; the lip having a width defining the distance the lip extends laterally outwardly from the upstanding peripheral wall to the rail contact surface and a length; the lip further including at least one pivot support; the pivot support disposed at a position intermediate the rail contact surface of the lip and the peripheral wall of the container at a spaced apart distance from the rail contact surface of the lip and the peripheral wall of the container;

a bracket disposed within the at least one pivot support on the lip;

the bracket including: a first section disposed within the pivot support and freely rotatable within the pivot support; a second section extending from the first section; and a third section extending rearwardly from the second section in a direction substantially parallel to the length of the lip; the third section disposed outwardly from the rail contact surface of the lip at a spaced apart lateral distance from the rail contact surface of the lip; the spaced apart distance defining a ladder rail receiving gap;

the bracket freely rotatable within the pivot support from at least a first position where the bracket second section is supported by the lip; to a second position where the second section has rotated upwardly from the lip and the lateral distance between the third section and the rail contact surface has shortened;

wherein the container is adapted for temporary attachment to a ladder having a ladder rail; and wherein upon disposal of the container on a ladder, the container is adapted such that the ladder rail is disposed within the rail receiving gap and the bracket is rotated to a second position wherein the ladder rail is pinched between the rail contact surface of the lip and the bracket third section, and the bracket third section rests atop a step of the ladder.

12. The container of claim 11, wherein the container includes a substantially planar, substantially rectangular bottom and four substantially planar upstanding walls defining the peripheral wall of the container.

13. The container of claim 11, wherein the lip is integral with the container.

14. The container of claim 11, wherein the lip extends laterally outwardly but not upwardly from the peripheral wall of the container.

15. The container of claim 11, wherein the bracket is permanently disposed within the pivot support of the lip.

16. The container of claim 11, wherein each pivot support comprises a loop within which the bracket first section is disposed.

17. The container of claim 11, wherein the bracket first, second, and third sections define a "U" shape.

18. The container of claim 11, wherein the bracket further includes a fourth section disposed at the distal end of the bracket and extending from the third section at substantially a right angle to the third section.

* * * * *